US005676603A

United States Patent [19]

Miller

[11] Patent Number: 5,676,603

[45] Date of Patent: Oct. 14, 1997

[54] GOLF CLUB WITH TRACKING DEVICE

[76] Inventor: Larry Miller, 1628 Treeside, Rochester, Mich. 48307

[21] Appl. No.: 731,957

[22] Filed: Oct. 23, 1996

[51] Int. Cl.[6] ..... A63B 69/36

[52] U.S. Cl. ..... 473/220; 473/253

[58] Field of Search ..... 473/220, 253, 473/267, 268, 219

[56] References Cited

U.S. PATENT DOCUMENTS

| | | | |
|---|---|---|---|
| 3,753,564 | 8/1973 | Brandell | 473/220 |
| 4,136,877 | 1/1979 | Antonious | 273/164 |
| 4,458,900 | 7/1984 | Antonious | 273/164 |
| 4,659,083 | 4/1987 | Szczepanski | 273/164 |
| 4,986,544 | 1/1991 | Benson | 273/183 |
| 5,082,277 | 1/1992 | Gingold | 273/164 |
| 5,201,124 | 4/1993 | Sherman | 33/265 |
| 5,442,861 | 8/1995 | Lorocco | 33/241 |

*Primary Examiner*—George J. Marlo

*Attorney, Agent, or Firm*—Gifford, Krass, Groh, Sprinkle, Patmore, Anderson & Citkowski, P.C.

[57] ABSTRACT

A tracking device for a golf club, which requires no electrical power source, is comprised of a body of fiberoptic material which is affixed to an exterior surface of the golf club. The fiberoptic material gathers ambient light along its length, and directs that light, through internal reflection, so as to cause it to exit at an end. The illumination provides a bright spot on the head of the golf club which traces the path of the moving club. The fiberoptic material may include a fluorescent dopant which absorbs light of short wavelength and converts that absorbed light to emitted light of a longer wavelength. Use of the fluorescent dopant enhances the intensity of the light emitted from the device.

19 Claims, 2 Drawing Sheets

FIG-4
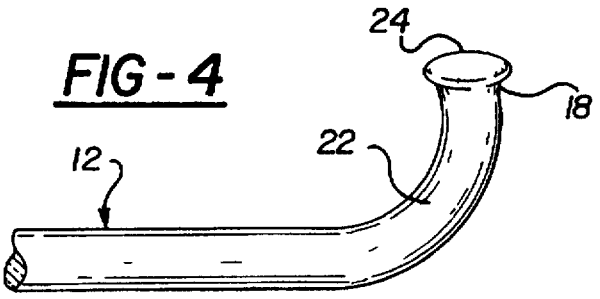
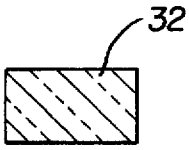
FIG-6A
FIG-5
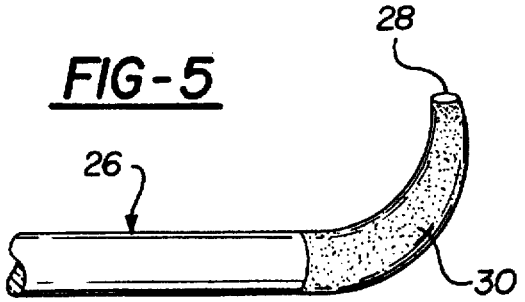
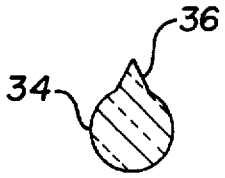
FIG-6B
FIG-7A
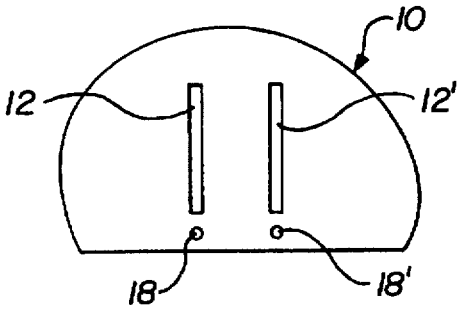
FIG-7B
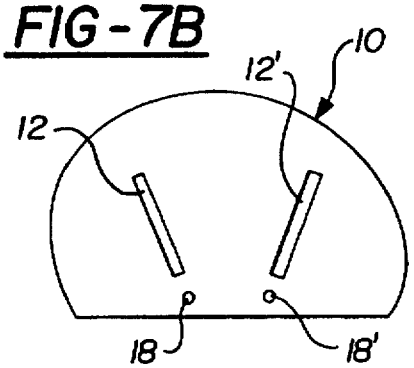
FIG-7C
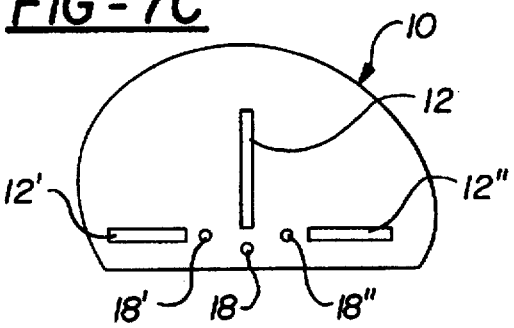
FIG-7D
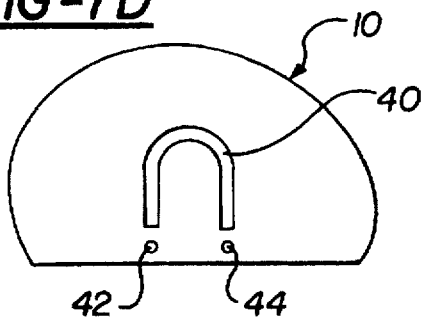

GOLF CLUB WITH TRACKING DEVICE

FIELD OF THE INVENTION

This invention relates generally to golf clubs. More specifically the invention relates to devices for tracking the movement of a golf club head. Most specifically, the invention relates to an optical device which provides a bright spot on a golf club head which allows a golfer to track the path of travel of the club.

BACKGROUND OF THE INVENTION

Golf is a game of ever increasing popularity, and it requires a player to precisely and accurately control both the point at which the club face strikes the ball, and the path of travel of the club, before, during and after contact with the ball. Such control is important in all aspects of the game, but is particularly important when it comes to putting.

A number of aiming devices have been developed to aid golfers in controlling and directing their strokes; but the art has not acknowledged the need for, or provided any, device for tracking the motion of a golf club. Some representative aiming devices are illustrated, for example, in the following. U.S. Pat. No. 4,986,544 discloses a golf putter having a raised sighting bar integral therewith. U.S. Pat. No. 5,082,277 is directed to a golf putter having a composite head which further includes an integral, raised sighting line on its upper surface. U.S. Pat. No. 4,659,083 discloses a putter having a series of converging lines etched into the top face thereof to assist a player in aiming. U.S. Pat. Nos. 4,458,900 and 4,136,877 both disclose sighting devices attached to a golf club head which require a player to align two spaced apart sighting members located at different levels on the club head.

While there are many aiming devices known in the prior art, such devices suffer from a number of shortcomings. First of all, these devices do not provide any means by which a point on a moving club may be tracked. Furthermore, many prior art devices require extensive modification and redesign of golf club heads, and it would be advantageous if a device could be readily incorporated into presently manufactured club designs. Also, a number of prior art aiming devices are illegal under the officially accepted rules of the United States Golf Association, and hence cannot be used in sanctioned play. Most prior art aiming devices are specifically adapted for putting and are not usable as tracking devices since they require careful alignment of sighting elements and/or produce a low visibility signal, both of which are detriments to using such devices to track a moving club.

Therefore, there is a need for a golf club tracking device which is simple in design, and readily incorporated into golf clubs of conventional design. The tracking device should also be legal under the standard rules of golf. It is further desirable that any such tracking device provide a high visibility signal, which may be readily viewed under low ambient light conditions, and which can be readily employed to track the swing of a fast moving club such as a driver or iron.

As will be described in detail hereinbelow, the present invention provides a tracking device which is of simple construction and which may be readily incorporated into a number of differently configured golf clubs of conventional design. The device of the present invention does not utilize any external power source, which would be illegal under the rules of golf, but relies upon an ambient light gathering and concentrating member to provide a very high visibility signal which can be used to trace the swing of a rapidly moving golf club. These and other advantages of the present invention will be readily apparent from the drawings, discussion and description which follow.

BRIEF DESCRIPTION OF THE INVENTION

There is disclosed herein a golf club head having a tracking device associated therewith. The tracking device is comprised of an elongated body of an ambient light gathering material, and operates to absorb incident light along its length and to direct that light through and out of an end thereof. The projected light constitutes a tracking signal, and the body of ambient light gathering material is affixed to the golf club head so that the tracking signal is projected from the golf club head.

The body of light gathering material may be positioned on the golf club head so that the length thereof is also exposed on a top face of the golf club, and in some instances is perpendicular to the striking face of the golf club to provide a further tracking aid. In some instances, the ambient light gathering material includes a fluorescer therein which operates to shift short wavelength light to longer wavelength light, thereby increasing the intensity of the signal. The ambient light gathering material may comprise a core material of a first refractive index having a cladding thereupon of a second refractive index, lower than the first refractive index to further enhance the light directing ability of the body.

The body of ambient light gathering material may be coated with a light reflective material along portions of its length to enhance its light directing ability, and may be tapered, or curved, and may also include a lens at its end to focus and direct the tracking signal.

In particular instances, the golf club may be configured to retain the body of ambient light gathering material in a groove formed in its top face. In other embodiments, the club may include several bodies of ambient light gathering material. The present invention is readily adapted to putters as well as drivers and irons.

BRIEF DESCRIPTION OF THE DRAWINGS

FIG. 4 is a perspective view of a portion of a body of ambient light gathering material configured in accord with the present invention;

FIG. 5 is a perspective view of a portion of another body of ambient light gathering material structured in accord with the present invention;

FIGS. 6A and 6B are cross-sectional views of yet other bodies of ambient light gathering material structured in accord with the present invention; and FIGS. 7A–7D are schematic depictions of golf club heads including other configurations of bodies of ambient light gathering material in accord with the present invention.

DETAILED DESCRIPTION OF THE INVENTION

In accord with the present invention, there is provided a tracking device for a golf club. The tracking device is operative to provide a bright spot of light which is visible on the golf club head. This light spot constitutes a tracer signal which aids a golfer in aligning and tracking the path of travel of the golf club before, during and after contact with the ball. While the present invention can be implemented through the use of a light source, such as a light emitting diode, in combination with a battery, in the most preferred embodiment, the present invention utilizes no external power source, and this is important since the rules of the game of golf consider golf clubs having such power sources to be illegal for sanctioned play. In the most preferred embodiment of the present invention, the tracking device is constituted by a body of ambient light gathering material which operates to collect light and direct the light, through internal reflection, to one end of the body. This light provides a bright spot having an intensity greater than the intensity of ambient illumination. This bright spot is a reference point for the golfer which gives immediate and continuous neuromuscular feedback enabling him or her to precisely control the path of travel of the moving golf club.

Figure 1:
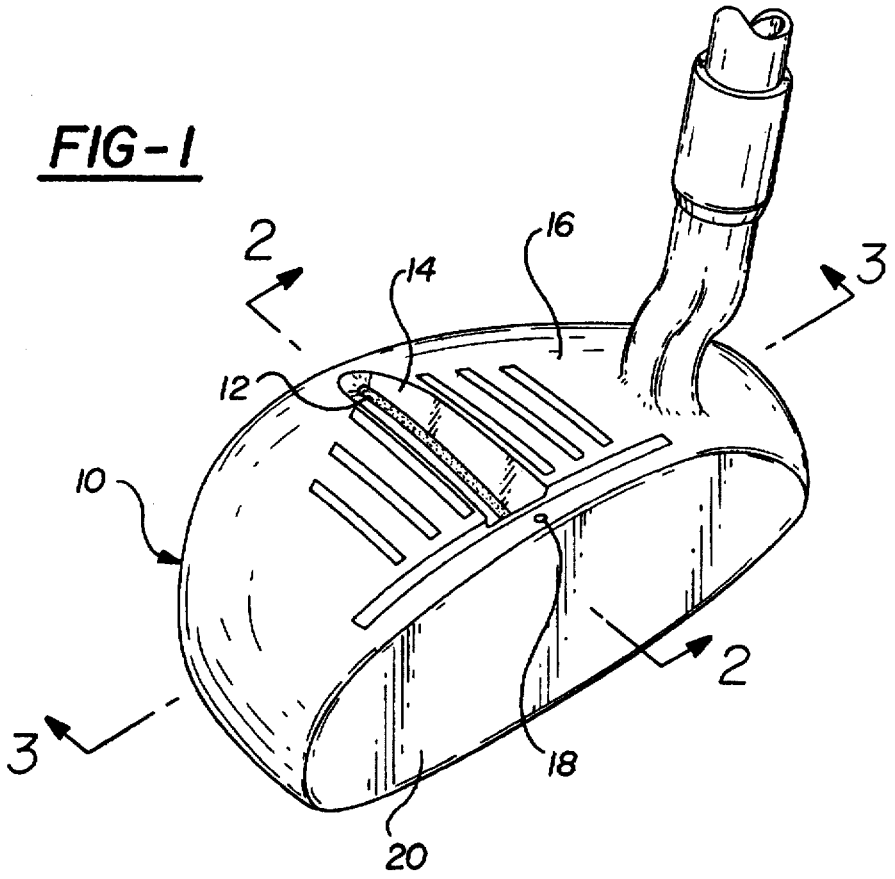
FIG. 1 is a perspective view of the head of a golf club which includes the tracking device of the present invention.

Referring now to FIG. 1, there is shown an embodiment of the present invention as implemented in a putter. As illustrated, the putter is of the type known as a mallet head putter, but it is to be understood that the present invention may be similarly implemented in connection with putters of other design as well as drivers and irons. FIG. 1 specifically illustrates a putter head 10 having a length of a body of an ambient light gathering material 12 disposed in a groove 14 on an upper face 16 thereof. An end 18 of the body of ambient light gathering material 12 is disposed so as to be visible at upper face 16 of the golf club head 10. In the illustrated embodiment, the length of the body of ambient light gathering material is disposed so as to be substantially perpendicular to the striking face 20 of the club head 10.

Figure 2:
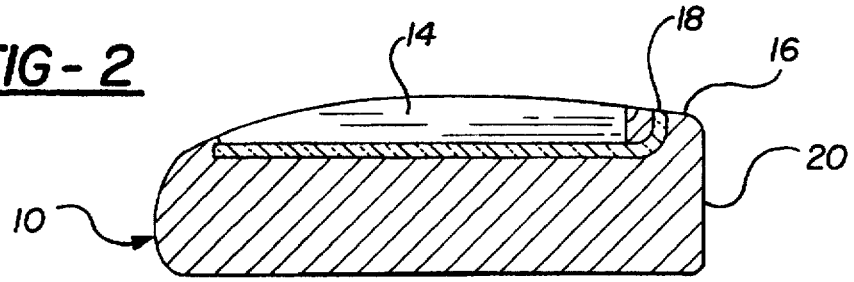
FIG. 2 is a cross-sectional view of the golf club head of FIG. 1 taken along line 2—2.

FIG. 2 shows the golf club head 10 of FIG. 1 in a cross-section as taken along line 2—2. As will be seen, the body of ambient light gathering material 12 is recessed in a groove 14 slightly below the top surface of the club head 10. The body of ambient light gathering material 12 is curved proximate one end 18, so that that end 18 is exposed at the top face 16 of the club head 10.

In operation, ambient light strikes the body of light gathering material 12 and is absorbed along the length thereof. The body of light gathering material 12 constitutes a light pipe which, through internal reflection, directs the ambient light along its length, until the lights exits from the ends thereof. This phenomenon of light piping is known in the art, and is the basis of fiber optic, signal transmission systems. As is further known in the art, such light piping can be enhanced by providing a body of ambient light gathering material which constitutes a light transmitting core having a cladding thereupon. By selecting the refractive indices of the core and cladding such that the cladding has a lower index, internal reflection is enhanced, and the intensity of the light exiting the ends of the fiber is increased.

While the body of ambient light gathering material may simply operate to direct ambient light, unchanged, to its ends, it has been found that a dramatic increase in intensity may be obtained if a fluorescent material is included therein. The fluorescent material operates to absorb shorter wavelengths of ambient light, typically light in the blue and near ultraviolet portions of the spectrum, and to re-emit this light at a longer wavelength, typically in the red, yellow or green portions of the spectrum. This fluorescence accomplishes two things which enhance the light intensity. First of all, light is shifted from low visibility wavelengths, and concentrated at wavelengths to which the human eye is more sensitive. Additionally, the re-emission of the light is in random directions within the body; therefore, the fluorescent molecules act as scattering centers. As a result, light which may have passed directly through the body, since it may have entered at an angle too steep to be internally reflected, may be scattered at a shallower angle relative to the internal surface of the body so as to be trapped by total internal reflection.

One material having utility in the present invention is a scintillating fiber sold by Poly-Optical Products, Inc. of Irvine, Calif. under the designation OptiBright. These fibers are comprised of a polystyrene core having a refractive index of approximately 1.60 which is clad with a polymethyl methacrylate coating typically comprising 3 to 4% of the total diameter of the fiber, and having a refractive index of approximately 1.49. These fibers include a fluorescent dopant therein, typically an organic dye, selected to produce a desired color. It has been found that red, yellow and green colon and most suitable for the present invention. Most preferably, the ambient light gathering material employed in the present invention will have a cross-sectional diameter in the range of 0.5 to 10 millimeters.

Figure 3:
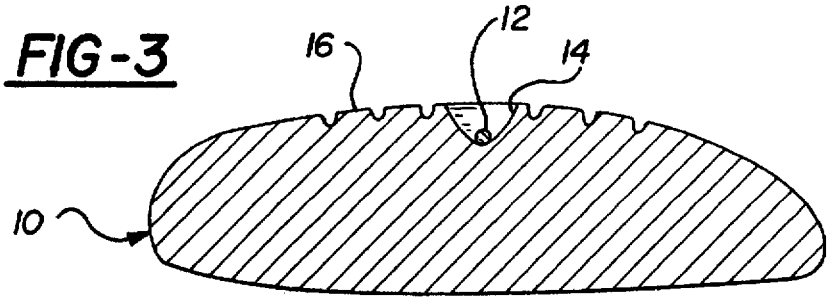
FIG. 3 is a cross-sectional view of the golf club head of FIG. 1 taken along line 3—3.

It will be noted from FIG. 2 that only one end 18 of the body of ambient light gathering material 12 is positioned to be visible on the upper face 16 of the club head 10. As will be described hereinbelow, in some instances, both ends may be positioned to be visible. When only one end is visible, as in FIG. 2, it may be desirable to coat the other end of the body 12 with a light reflective coating, such as a layer of metal or paint. As further shown in FIG. 2, a portion of the length of the body of ambient light gathering material 12 is also exposed at the top face of the club. It is important that a substantial portion of the length of the body 12 be exposed so that it can gather ambient light. In accord with the present invention, the length may be exposed along any portion of the golf club, including the shaft. However, there is some particular advantage to exposing the length along the top face of the club, since it will then provide a relatively bright line which further aids tracking of the club. As shown in FIGS. 1–3 the length of the body 12 is oriented so as to be substantially perpendicular to the striking face 20 of the club head 10. This provides a dual tracking signal which consists of a very bright spot of light at the end 18 of the body, and a line of somewhat lesser intensity constituted by the remainder of the body 12. It has been found that this arrangement provides a visual signal to the golfer which enables him or her to properly position and swing the club so that the ball is struck at the optimum spot on the club face and so that proper follow through is achieved. In yet other embodiments, the second end of the body 12 may also be exposed on the top face 16 of the club, and may also be aligned with the length of the body 12 as well as the first end 18.

As further illustrated in FIGS. 1–3, the body of ambient light gathering material 12 is recessed in a groove 14 in the top face 16 of the club. This positioning is advantageous insofar as it enhances the appearance of the club, and avoids any projections from the upper surface thereof, which, in some instances, could be deemed to be illegal accessories. In addition, the walls of the groove further aid in collecting and directing light into the body of material 12.

Referring now to FIG. 4, there is shown an enlarged, perspective view of a portion of a body of ambient light gathering material 12 of the type utilized in the FIG. 1 embodiment. As shown, the body 12 includes a relatively straight portion, and a bend 22 proximate the end 18 thereof. As will be further noted, the body 12 includes a lens 24 at the end 18. This lens 24 aids in focusing and directing the light emanating from the end 18. In the illustrated embodiment, the lens 24 is integral with the end 18, and is formed by simply heating and melting a portion of the body 12. In other instances, the lens may be a separately affixed item.

FIG. 5 depicts another embodiment of a body of ambient light gathering material 26 in accord with the present invention. The body 26 of the FIG. 5 embodiment is tapered proximate the end 28. Since the taper reduces the diameter of the end 28, the resultant intensity of the light projecting therefrom is increased. In accord with yet another aspect of the present invention, the body 26 of FIG. 5 includes a light reflective coating 30 on a portion thereof, proximate the tapered end 28. This coating 30 may be comprised of a metallic coating, such as a vapor deposited, or electrolessly deposited metal, or it may comprise a paint, such as a white paint, or a paint loaded with metallic pigments. The coating 30 serves to prevent light from leaving the body in the region of the taper and the bend. Since this portion of the body is not employed for gathering ambient light, the presence of the reflective coating will not detract from the efficiency of the fiber, and will prevent unwanted light loss.

As depicted in FIGS. 1–5, the ambient light gathering material is comprised of a body having a circular cross-section; however, this particular configuration is not required by the present invention, and in various embodiments, bodies of ambient light gathering material of other cross-sections may be advantageously employed. FIG. 6A depicts a body of ambient light gathering material 32 having a rectangular cross-section. A body thus configured presents a larger area for collection of ambient light, and in addition, if the length of the body is employed to provide a further tracking aid, it establishes a broad, visible line.

FIG. 6B depicts another embodiment of body 34 of ambient light gathering material. In this particular embodiment, the body 34 is configured to have a generally circular cross-section; but, further includes a projecting ridge 36 thereupon. The presence of the sharp edge on the ridge 36 will cause light to "leak" from the body 34. This leakage of light will provide a bright line running along the length of the body 34 providing a further tracking signal. Clearly, other embodiments of light gathering material may be similarly implemented in accord with the present invention.

The general principle of the present invention may be implemented in a number of other embodiments. For example, as illustrated in FIG. 7A, the golf club head 10 may include two separate bodies of ambient light gathering material 12, 12' disposed in an approximately parallel relationship, and running generally perpendicular to the striking face 20 of the golf club head 10. In this instance, there are provided two ends 18, 18', each of which projects a tracking signal.

FIG. 7B depicts yet another embodiment of club head 10 having two bodies of ambient light gathering material 12, 12', as in FIG. 7A. However, the bodies 12, 12' are both oriented in a non-parallel relationship, and at an angle of less than 90° to the striking face 20 of the club. This embodiment is particularly suited for application to putters, since the converging lines defined by the lengths of the bodies 12, 12' will provide a focal point for the golf ball.

FIG. 7C depicts yet another embodiment of club head 10 which includes a first body of ambient light gathering material 12 oriented perpendicular to the striking face 20 of the club. The FIG. 7C embodiment further includes two additional bodies of ambient light gathering material 12', 12" which are disposed generally parallel to the striking face 20 of the club head 10. In one particularly preferred embodiment, the central body 12 is of a first color, such as red, and the auxiliary bodies 12', 12" are of contrasting colors such as green or amber. It should further be noted, and with regard to FIG. 7C, that in some instances golfers favor clubs having a relatively narrow width dimension. For such clubs, the tracking device of the present invention is configured so that the length of the body of ambient light gathering material is disposed generally parallel to the striking face of the club, in a manner similar to bodies 12' and 12". In such instances, a single body, or two bodies may be employed. Where two separate bodies, for example body 12' and 12" are employed, they may be positioned relatively close so that the corresponding ends thereof, for example ends 18' and 18" are very close to one another so as to provide a single tracking signal. In yet other instances, the ends of the two bodies 12', 12" may be fused together so as to direct the light gathered by each to a single point. In yet other instances, a mirror or reflective device may be employed to direct light from multiple bodies to a single point. All of such embodiments are within the scope of the present invention.

Referring now to FIG. 7D, there is shown yet another embodiment of the present invention in which a golf club head 10 includes a single body 40 which is curved so that the first end thereof 42 and the second end thereof 44 are both positioned to provide tracking signals. In yet other embodiments, the two ends 42, 44 may be joined to provide a single signal, either by mechanically coupling the ends or utilizing optics, as described hereinabove. While the body 40 in the FIG. 7D embodiment is shown as being curved, it may be straight; and as described above, the two ends 42, 44, and the length of the body 40, may be linearly aligned.

In the foregoing embodiments, the end of the body of light gathering material is shown as being on an upper face of the golf club. In general, this placement is preferred; however, a second end may be placed so as to project a tracking signal from another face of the club, or from the shaft of the club. Such embodiments are particularly well suited for drivers, irons and the like.

In general, the present invention provides a golf club head having means associated therewith for generating one or more bright spots of light. The light constitutes a tracking signal analogous to a tracer bullet which enables the golfer to follow and control the path of travel of the club. While the invention may be implemented utilizing an electrically powered light source, it is most preferably implemented with a body of ambient light gathering material of the type described herein. Various bodies of light gathering material have been described as have been various positionings thereof. It is to be understood that within the scope of the present invention, other configurations of material and positioning may be similarly employed. For example, a body of light gathering material may be run up the shaft of the golf club so as to further gather light. And, the body may also be configured to provide an additional tracking signal on the shaft of the club. In other instances, a body of material may be disposed in a sinuous path along portions of a golf club head to further increase the light gathering area thereof. All of such embodiments are within the scope of the present invention, and the foregoing drawings, discussion and description are illustrative of particular embodiments thereof. It is the following claims, including all equivalents, which define the scope of the invention.

I claim:

1. A golf club head having associated therewith a tracking device comprising:

an elongated body of an ambient light gathering material which is disposed so as to absorb incident light along a length thereof and to direct said light through internal reflection therethrough to an end thereof, so that said light projects from said end so as to constitute a tracking signal; said body of ambient light gathering material including a fluorescent material therein which absorbs light of a first wavelength and re-emits light at a second wavelength which is longer than said first wavelength, wherein said body of ambient light gathering material is affixed to said golf club head so that said tracking signal is projected from said golf club head.

2. A golf club head as in claim 1, wherein a portion of the length of said body of ambient light gathering material is exposed at a top face of said club.

3. A golf club head as in claim 2, wherein said portion of the length of the body of ambient light gathering material exposed at the top face of the golf club is disposed substantially perpendicular to a striking face of said golf club head.

4. A golf club head as in claim 1, wherein said body of ambient light gathering material includes a core having a first index of refraction and a cladding material surrounding said core, said cladding material having a second index of refraction which is less than said first index of refraction.

5. A golf club head as in claim 1, wherein said body of ambient light gathering material has a circular cross-section.

6. A golf club head as in claim 1, wherein said body of ambient light gathering material is curved proximate the end thereof so that said tracking signal is projected in a direction substantially perpendicular to the length of said body of ambient light gathering material.

7. A golf club head as in claim 1, wherein a portion of the length of said body of ambient light gathering material is coated with a light reflective material.

8. A golf club head as in claim 1, wherein the width of said body of ambient light gathering material varies along the length thereof so that the width is a minimum at the end.

9. A golf club head as in claim 1, further including a lens disposed at the end of said body of ambient light gathering material, said lens being operative to direct the light projected from said end.

10. A golf club head as in claim 9, wherein said lens is integral with said body of ambient light gathering material.

11. A golf club head as in claim 1, wherein said body of ambient light gathering material is recessed below a plane defined by the top face of said golf club head.

12. A golf club head as in claim 11, wherein said body of ambient light gathering material is disposed in a groove which is formed in said golf club head and which is recessed below said plane.

13. A golf club head as in claim 1 further including a second elongated body of an ambient light gathering material.

14. A golf club head as in claim 13, wherein said second length of ambient light gathering material is disposed at right angles to the elongated body of ambient light gathering body.

15. A golf club head as in claim 1, wherein said body of ambient light gathering material is operative to direct said incident light to a first and a second end thereof so that said light projects from said first end and from said second end so as to constitute a first and a second aiming and tracking signal.

16. A golf club head as in claim 15, wherein said elongated body of an ambient light gathering material is configured as a curved body.

17. A golf club head as in claim 1, wherein said head is configured as a putter.

18. A golf club head as in claim 1, further including a shaft affixed thereto.

19. A golf club head having associated therewith a non-electrically powered tracking device, said tracking device comprising:

an elongated body of fiberoptic material which operates to absorb incident light along its length, and to direct a portion of said light, through internal reflection, to exit from an end thereof; and a fluorescent material disposed in said fiberoptic body, said fluorescent material being operative to absorb light of a first wavelength, and in response thereto to emit light of a second wavelength which is longer than said first wavelength; said fiberoptic body being disposed so that at least a portion of the length thereof is exposed upon a surface of the golf club head, whereby said fiberoptic body absorbs ambient light of said first wavelength, and emits light of said second wavelength, and directs said light of said second wavelength out an end of said fiberoptic body so as to provide a tracking signal.

* * * * *